US005542211A

United States Patent [19]

Colombo

[11] Patent Number: 5,542,211

[45] Date of Patent: Aug. 6, 1996

[54] REVOLVING SECURITY DOOR FOR BANKS AND THE LIKE

[75] Inventor: Attilio Colombo, Busto Arsizio, Italy

[73] Assignee: Tonali S.P.A., Desio, Italy

[21] Appl. No.: 489,235

[22] Filed: Jun. 12, 1995

Related U.S. Application Data

[63] Continuation of Ser. No. 153,145, Nov. 15, 1993, abandoned.

[30] Foreign Application Priority Data

Nov. 26, 1992 [IT] Italy ..... MI92A2702

[51] Int. Cl.[6] ..... E05D 15/02

[52] U.S. Cl. ..... 49/42; 109/8

[58] Field of Search ..... 49/42, 43; 109/8, 109/3

[56] References Cited

U.S. PATENT DOCUMENTS 3,285,209 11/1966 Pace ..... 49/42
4,060,039 11/1977 Lagarrigue ..... 109/8 X
4,341,165 7/1982 Calandritti et al. ..... 109/8
4,557,073 12/1985 Sandling ..... 109/8 X

FOREIGN PATENT DOCUMENTS 3730031 3/1989 Germany ..... 49/42

*Primary Examiner*—Philip C. Kannan
*Attorney, Agent, or Firm*—Rosen, Dainow & Jacobs Limited Liability Partnership

[57] ABSTRACT

A revolving security door for the controlled passage of persons from a non-protected environment to a protected environment, for example a bank, which permits the normal transit of persons even in the event of the interception of an unwelcome person, including a cylindrical chamber formed inside a structure, a turnstile rotatable within the chamber in a predetermined sense of rotation and having sectors each for accommodating a person, an entry aperture and an exit aperture formed in the structure, a sensor associated with the structure for detecting an unwelcome person or object and for emitting an alarm signal, an emergency door associated with the exit aperture and activated to close by the said alarm signal, the said door comprising a first panel and a second panel which are held together and made to rotate in the opposite sense of rotation from that of the turnstile, after the door has been closed by the first panel and before the door is opened by the opening of both panels.

10 Claims, 3 Drawing Sheets

REVOLVING SECURITY DOOR FOR BANKS AND THE LIKE

This application is a continuation of application Ser. No. 08/153,145, filed Nov. 15, 1993; now abandoned.

BACKGROUND OF THE INVENTION

The present invention relates to a revolving security door for allowing the controlled passage of persons from a non-protected environment to a protected environment, for example a bank, including a cylindrical chamber formed inside a structure, a turnstile rotatable inside the chamber in a predetermined sense of rotation and having sectors each for accommodating a person, the structure being formed with an entry aperture for entry into the chamber from the non protected environment and an exit aperture for exit from the chamber into the protected environment and having a sensor associated therewith in correspondence with the entry aperture for emitting an alarm signal and an emergency door associated with the exit aperture and activated to close by the said alarm signal.

In general, such revolving security doors are intended to control the passage of persons from one environment to another.

In particular, they are commonly fitted where it is necessary to prevent the intrusion of an unwelcome person, for example an armed person, from a non-protected environment, such as a public street, into a protected environment such as the premises of a bank.

Another example of unwelcome person is a person without an appropriate electronic pass or other identification system who attempts to intrude into an environment which may only be accessed by persons provided with the appropriate pass or other identification system.

In a known arrangement, the emergency door is a single panel which closes on emission of the alarm signal and reopens as soon as the sector occupied by the unwelcome person, for example an armed person who sets off the alarm, has passed totally through the exit aperture. This arrangement is satisfactory from the point of view of blocking the access of the unwelcome person but has the disadvantage of blocking the normal transit of persons through the revolving door. In fact, a person who happened to be in the turnstile sector immediately downstream of that occupied by the unwelcome person would find himself at the exit aperture when this was still completely closed and would be unable to get out immediately but would have to wait some time and would then find himself in difficulty on attempting to leave his sector since this would already be moving beyond the exit aperture making this inaccessible.

Therefore, unless he acts extremely fast, the person occupying the turnstile sector downstream of the armed person is also returned to his starting point, along with the unwelcome person.

It has been suggested that the reopening of the emergency door should be speeded up. However, as may be easily imagined, this suggestion involves a series of other disadvantages such as an increase in the dimensions of some parts, more noise and bumps, etc.

A revolving security door has been suggested in which the emergency door is formed by two panels. Clearly such a door would open the exit aperture faster, without the above disadvantage. Unfortunately, however, such a revolving door has the drawback of posing a serious obstacle to access to the sector upstream of that occupied by the unwelcome person, that is by a person wishing to pass in the opposite direction, that is from the protected environment to the non-protected environment.

In fact, the sudden closure of the aperture by the double door leaves hardly sufficient time for entry to the sector and exposes a person attempting to enter to the danger of being struck by at least one door, if not by both.

Time-staggered control of the two panels of the double door does not solve the problem either and would require, in addition, that the turnstile be temporarily stopped or that its rotation be altered.

Therefore a person about to pass through in the opposite direction finds it would be dangerous to enter the first sector and is normally obliged to wait for the sector occupied by the unwelcome person to pass, and possibly for other occupied sectors to pass, before encountering a free sector.

Therefore such a revolving door would also impede normal traffic.

The problem on which the present invention is based is that of devising a revolving door of the type specified above, which has structural and operational characteristics such as to overcome the above disadvantages.

SUMMARY OF THE INVENTION

The above described problem is solved by a revolving door of the type specified, characterised in that the emergency door includes a first panel and a second panel located respectively upstream and downstream of the exit aperture relative to the sense of rotation of the turnstile, and in that, after the emergency door has been closed by closure of the first panel, the panels are held together and are made to rotate together, in the opposite sense of rotation to that of the turnstile, before the emergency door is opened by the opening of both panels.

Further characteristics and advantages of the revolving door of the present invention will become apparent from the following description of a preferred embodiment, provided purely by way of non-limitative example, with reference to the appended drawings.

DETAILED DESCRIPTION OF THE PREFERRED EMBODIMENT

Figure 1:
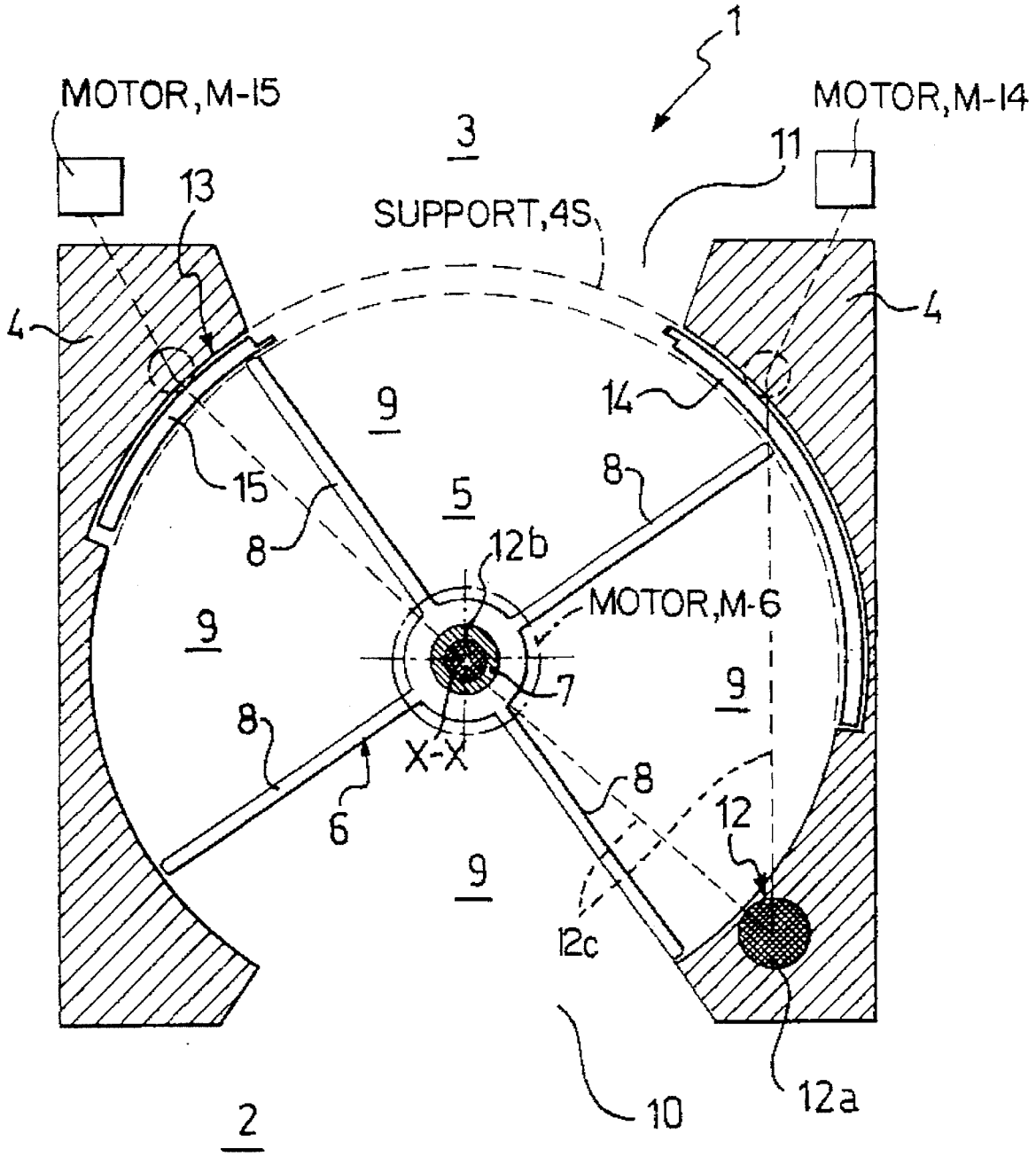
FIG. 1 is a schematic plan view of a revolving door according to the invention.
Figure 2:
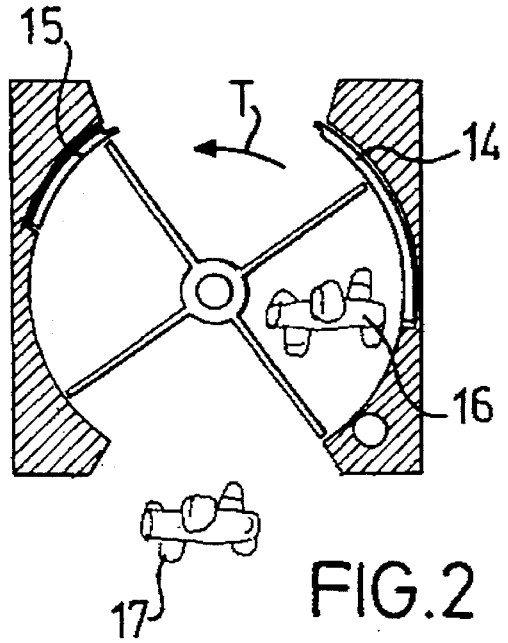
FIGS. 2 to 9 are reduced-scale schematic plans of the revolving door of FIG. 1 in successive operating phases.

With reference to the appended drawings, a revolving security door for the controlled passage of persons from a non-protected environment 2 to a protected environment 3 is generally indicated 1.

Such a revolving door would be installed in a bank, for example, to block access to armed persons.

The revolving door 1 includes a fixed structure or housing 4 and a cylindrical chamber 5 formed by generally cylindrical inner walls having an axis X—X.

The turnstile 6 is rotatable inside the chamber 5 about an upright 7 in a predetermined sense of rotation T, which is anticlockwise in the example given, and is driven by motor means which are in themselves conventional and schematically shown as M-6 in FIG. 1. Manual rotation of the turnstile is not, however, to be excluded.

The turnstile 6 includes partitions 8, of which there are four in the example given. Pairs of partitions 8 define sectors 9 each for accommodating a person.

The chamber 5 is in communication with the non-protected environment 2 through an entry aperture 10 and with the protected environment 3 through an exit aperture 11, the angular extent of the said apertures, viewed from the axis X—X, being no greater than the angular extent of the sectors 9.

A sensor 12, in itself known, is fitted to the revolving door 1 to check the passage of persons or things. In the example, the sensor 12 is fitted to the structure 4 in correspondence with the entry aperture 10 and is sensitive to an unwelcome presence, for example a weapon, and arranged to emit an alarm signal when the unwelcome circumstance occurs.

In the example, the sensor 12 comprises a metal detector, one part **12*b* of which is housed in the upright 7 and the other part 12*a* of which is housed in the structure 4**.

The revolving door 1 is completed by an emergency door 13 for closing and opening the exit aperture 11 and which is activated by well-known circuitry or equivalent control means to close the exit aperture by the alarm signal as indicated schematically by circuit 12C in FIG 1.

The emergency door 13 includes a first sliding panel 14 and a second sliding panel 15, positioned upstream and downstream respectively of the exit aperture 11 relative to the sense of rotation T of the turnstile 6.

The panels are supported by part 45 of the structure 4 for rotation about the axis X—X and are driven by motor means which are in themselves known and schematically shown as M-14 and M-15 respectively in FIG. 1.

Viewed on the axis X—X, the angular extent of the first panel 14 is substantially the same as the angular extent of the exit aperture 11 while the angular extent of the second panel 15 is substantially half that of the exit aperture.

The total angular extent of the two panels is therefore greater than the angular extent of the exit aperture 11, being substantially one-and-a-half times the angular extent of the exit aperture.

In operation, with reference to an initial condition (FIG. 1) in which both panels are open and in which 16 indicates an unwelcome person, the latter has occupied a sector 9 whereby the apparatus causes the alarm signal to be given and activates the closure of emergency door 13 which occurs by movement of the first panel 14 alone, the second panel 15 remaining in its open position.

Figure 3:
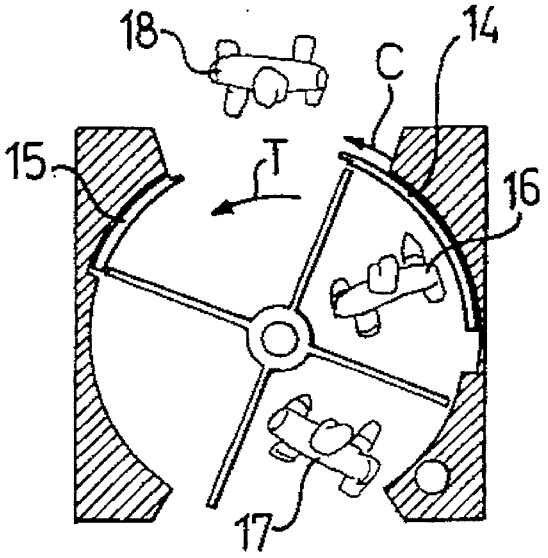
Figure 4:
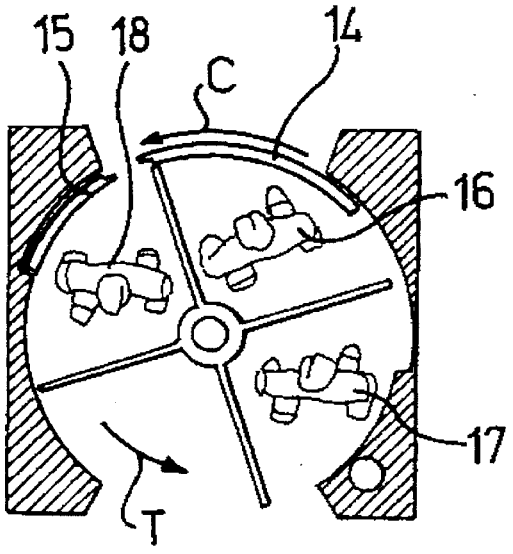
Figure 5:
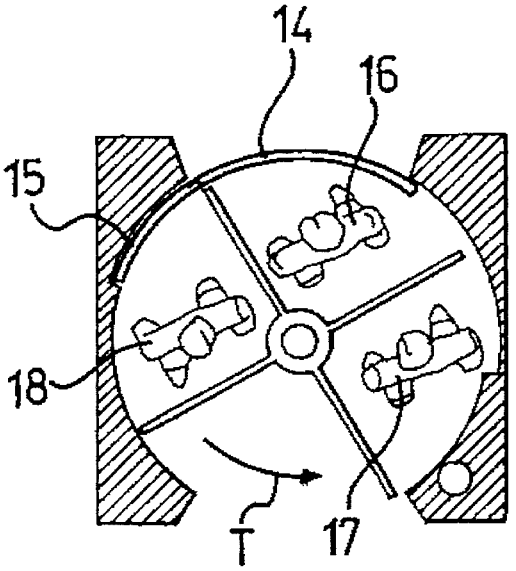

The apparatus then causes, the first panel 14 thus rotates about the axis X—X in the direction of the arrow C (see FIGS. 3 and 4) until it meets the second panel 15 and stops in contact with it (see FIG. 5).

At this point the sector 9 occupied by the unwelcome person is facing the exit aperture 11 which is closed by the first panel 14 of the emergency door. The unwelcome person is therefore unable to enter the protected environment 2.

Figure 6:
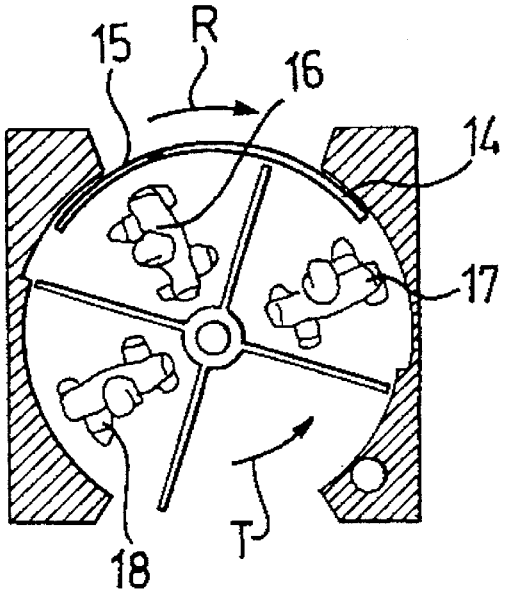
Figure 7:
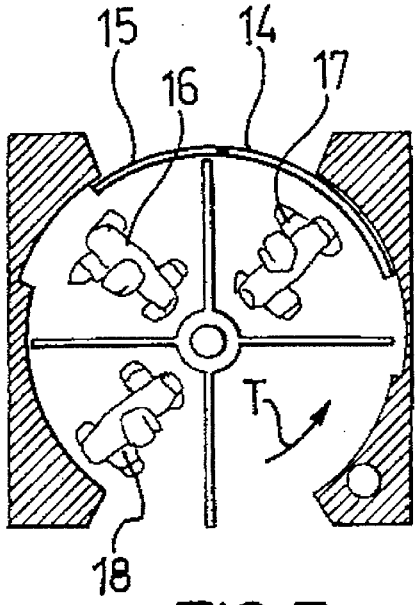

At this point, the panels 14 and 15 are held together and the apparatus causes the joined panels to rotate together in the opposite sense from that of the turnstile, that is in the direction of the arrow R (see FIG. 6), through an angular distance which in this example, is substantially half the angular amplitude of the exit aperture 11 (see FIG. 7).

This angular movement of the two panels 14 and 15, which are held together while keeping the exit aperture 11 closed, is allowed by virtue of the fact that the total angular extent of the combined panels is greater than the angular extent of the exit aperture. During this angular movement the unwelcome person cannot enter the protected environment.

Figure 9:
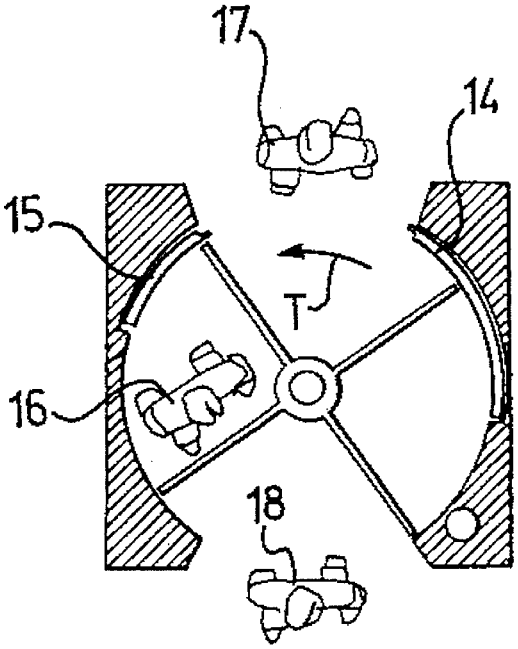

At this point, the opening of the emergency door 13 whereby the apparatus activates both panels 14 and 15 which are driven to move in the direction of the arrows A1 and A2 respectively until the exit aperture 11 is completely open (see FIG. 9).

In other words, after the emergency door 13 has been closed by closure of the first panel 14, and before the door 13 has been opened by the simultaneous displacement of both panels 14 and 15, the first and second panels are held together and are made to rotate in the opposite sense of rotation from that of the turnstile, in the example through an angular extent which is substantially half the angular extent of the exit aperture.

During this angular movement the exit aperture remains closed by the two adjoining panels.

Figure 8:
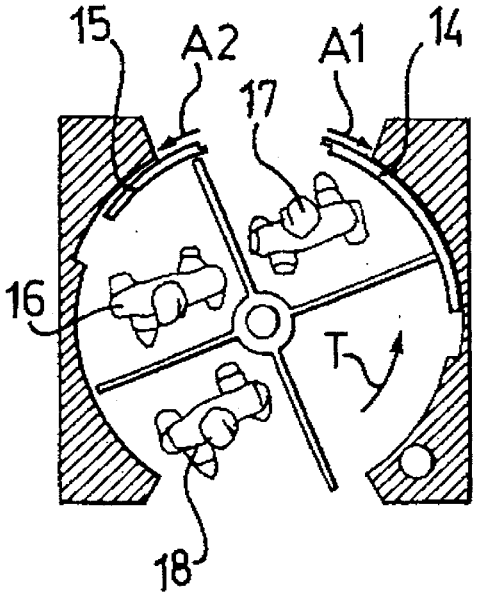

A person passing from the non-protected environment 2 to the protected environment 3 and occupying the sector immediately upstream of the sector occupied by the unwelcome person 16 is indicated 17. The person 17 is able to leave the sector easily (see FIGS. 8 and 9).

A person passing in the opposite direction and using the sector immediately downstream of the sector occupied by the unwelcome person 16 is indicated 18. The person 18 is able to enter the sector easily (see FIGS. 3 and 4).

The revolving security door of the invention has been described with reference to its use in a bank or the like.

Obviously it is suitable to be fitted in other circumstances where it is necessary to prevent persons from passing, for example in order to prevent a person who is radioactively contaminated above a certain level from leaving an environment, such as a radiological laboratory, and entering a public environment.

Another example of application would be in department stores to prevent shoplifting.

Yet another example would be in premises where each person in transit must have a pass or other identification system checked.

In addition, the above description which referred to a person should also be understood as being applicable to an object. The revolving door of the invention is also suitable for preventing an unwelcome object, for example a weapon thrown into a sector, from being carried into the protected environment where it could be seized.

The main advantage of the revolving security door according to the present invention is that it permits the normal, regular and safe transit of other persons even when an unwelcome person has been intercepted thanks to unexceptionable use of the remaining sectors of the turnstile, including those immediately downstream and upstream of the sector temporarily occupied by the unwelcome person. The upstream sector will accommodate safely a person who needs to leave the protected environment since the second panel remains open, and a person entering the protected environment will be able to leave the downstream sector calmly as both panels slide open at the same time while the sector intermediate the upstream and downstream sectors is generally efficient adjacent one of the inner walls of the chamber.

The revolving door of the invention is also expected to have the additional advantages of unexceptionable regularity in operation and uncommon reliability since the speeds at which the turnstile and the panels are operated can be kept constant and in any case within limits recommended by good construction practices.

Obviously an expert in the field will be able to make many alterations and variations to the revolving door described above in order to meet specific contingent requirements, without thereby departing from the protective scope of the present invention, as defined in the claims which follow.

I claim:

1. A revolving security door for the controlled passage of persons from a non-protected environment to a protected environment including a cylindrical chamber formed inside a structure, a turnstile rotatable within the chamber in a predetermined sense of rotation and having sectors each for accommodating a person, the structure being formed with an entry aperture for entry into the chamber from the non-protected environment and an exit aperture for exit from the chamber to the protected environment, a sensor associated with the structure in the correspondence with the entry aperture for emitting an alarm signal when an unwelcome person has entered a first sector of said sectors within the chambers, and an emergency door associated with the exit aperture and activated to close by the said alarm signal, characterized in that the emergency door includes a first panel and a second panel located in their open positions respectively upstream and downstream of the exit aperture relative to the sense of rotation of the turnstile, and the apparatus further comprises means to move said panels to be joined and to continue to block said exit aperture, means to hold the panels joined and to rotate them together in the opposite sense of rotation from that of the turnstile until the turnstile first sector is rotated past the exit aperture, and means for opening the emergency door by returning both panels to their open positions and thus unblocking the exit aperture.

2. A revolving security door according to claim 1, characterised in that the width of the first panel is substantially equal to the width of the exit aperture, in that the width of the second panel is substantially half that of the exit aperture and in that the angular displacement of the two panels held together is substantially equal to half the width of the exit aperture.

3. In a revolving security door apparatus for the controlled passage of persons from a non-protected environment to a protected environment, the apparatus including:

a. a housing defining therein a cylindrical chamber about a vertical axis, b. a turnstile rotatable about said axis within said chamber, said turnstile having a plurality of sectors, each for accommodating a person, c. first motor means for rotating said turnstile, d. said housing further defining separate entry and exit apertures respectively for a person to enter and exit the chamber, and e. a sensor mounted to the housing for sensing when an unwelcome person has entered the chamber and is located within a first of said plurality of sectors, the improvement comprising:

(1) an emergency door movably supported by said housing, said emergency door having angular extent at least sufficient to block said exit aperture, (2) second motor means for moving said emergency door to selectively block or expose said exit aperture, (3) control means responsive to said sensor for activating said first and second motor means for moving said turnstile and emergency door in the following sequence when the sensor senses the presence of an unwelcome person in said first sector:

i. move said emergency door to block said exit aperture, ii. rotate said turnstile causing said first sector to rotate past said blocked exit aperture, iii. further move said emergency door to open and unblock said exit aperture, and iv. further rotate said turnstile enough for sectors upstream and downstream of said first sector to be generally adjacent said entry and exit apertures respectively.

4. An apparatus according to claim 3 wherein said turnstile has four sectors, each having a 90° angular extent.

5. An apparatus according to claim 3 wherein said emergency door comprises a first panel upstream of the exit aperture relative to the rotational direction of the turnstile, said first panel having angular extent substantially equal to that of said exit aperture.

6. In a revolving security door apparatus for the controlled passage of persons from a non-protected environment to a protected environment, the apparatus including:

a. a housing defining therein a cylindrical chamber about a vertical axis, b. a turnstile rotatable about said axis within said chamber, said turnstile having a plurality of sectors, each for accommodating a person, c. first motor means for rotating said turnstile, d. said housing further defining separate entry and exit apertures respectively for a person to enter and exit the chamber, and e. a sensor mounted to the housing for sensing when an unwelcome person has entered the chamber and is located within a first of said sectors, the improvement comprising:

(1) an emergency door formed of first and second panels respectively upstream and downstream of the exit aperture relative to the rotational direction of the turnstile and movably supported by said housing, said first panel having angular extent substantially equal to that of said exit aperture and said second panel having angular extent substantially half that of the exit aperture, (2) second motor means for moving said panels to selectively block or expose said exit aperture, (3) control means responsive to said sensor for activating said first and second motor means for moving said turnstile and panels in the following sequence when the sensor senses the presence of an unwelcome person in said first sector:

i. move said first panel and said turnstile together such that said first panel and the sector adjacent said first panel rotate in a first direction until said first panel blocks said exit aperture, ii. couple said first panel to said second panel and rotate the coupled panels in a second direction opposite said first direction to continue to overlie and bar the exit aperture, iii. further rotate the turnstile in said first direction causing said first sector to rotate past said blocked exit aperture, iv. further move said first panel in said second direction to open and unblock said exit aperture, and v. further rotate said turnstile in said first direction enough for sectors upstream and downstream of said first sector to be generally adjacent said entry and exit apertures respectively.

7. In a revolving security door apparatus for the controlled passage of persons from a non-protected environment to a protected environment, the apparatus including:

a. a housing defining therein a cylindrical chamber about a vertical axis, b. a turnstile rotatable about said axis within said chamber, said turnstile having a plurality of sectors, each for accommodating a person, c. first motor means for rotating said turnstile, and d. said housing further defining separate entry and exit apertures respectively for a person to enter and exit the chamber.

(1) an emergency door movably supported by said housing, said emergency door having angular extent at least sufficient to block said exit aperture, (2) second motor means for moving said emergency door to selectively block or expose said exit aperture, (3) means for activating said first and second motor means for moving said turnstile and emergency door in the following sequence when the sensor senses the presence of an unwelcome person in said first sector:

i. move said emergency door to block said exit aperture, ii. rotate said turnstile causing said first sector to rotate past said blocked exit aperture, iii. further move said emergency door to open and unblock said exit aperture, iv. further rotate said turnstile enough for sectors upstream and downstream of said first sector to be generally adjacent said entry and exit apertures respectively.

8. In a revolving security door apparatus for the controlled passage of persons from a non-protected environment to a protected environment, the apparatus including:

a. a housing having generally cylindrical inner walls which define a chamber about a vertical axis, b. a turnstile rotatable about said axis within said chamber, said turnstile having a plurality of sectors, each for accommodating a person, c. first motor means for rotating said turnstile, d. said housing further defining separate entry and exit apertures respectively for a person to enter and exit the chamber, and e. a sensor mounted to the housing for sensing when an unwelcome person has entered the chamber and is located within a first of said plurality of sectors, the improvement comprising:

(1) an emergency door movably supported by said housing, said emergency door having angular extent at least sufficient to block said exit aperture, (2) second motor means for moving said emergency door to selectively block or expose said exit aperture, (3) control means responsive to said sensor for activating said first and second motor means for moving said turnstile and emergency door in the following sequence when the sensor senses the presence of an unwelcome person in said first sector:

i. move said emergency door to block said exit aperture, ii. rotate said turnstile causing said first sector to rotate past said blocked exit aperture, iii. further move said emergency door to open and unblock said exit aperture, and iv. further rotate said turnstile enough for sectors upstream and downstream of said first sector to be generally adjacent said entry and exit apertures respectively, and for said sector intermediate said upstream and downstream sectors to be adjacent one of said inner walls of said chamber to intercept said unwelcome person.

9. In a revolving security door apparatus for the controlled passage of persons from a non-protected environment to a protected environment, the apparatus including:

a. a housing having generally cylindrical inner walls which define a chamber about a vertical axis, b. a turnstile rotatable about said axis within said chamber, said turnstile having a plurality of sectors, each for accommodating a person, c. first motor means for rotating said turnstile, d. said housing further defining separate entry and exit apertures respectively for a person to enter and exit the chamber, and e. a sensor mounted to the housing for sensing when an unwelcome person has entered the chamber and is located within a first of said sectors, the improvement comprising:

(1) an emergency door formed of first and second panels respectively upstream and downstream of the exit aperture relative to the rotational direction of the turnstile and movably supported by said housing, said first panel having angular extent substantially equal to that of said exit aperture and said second panel having angular extent substantially half that of the exit aperture, (2) second motor means for moving said panels to selectively block or expose said exit aperture, (3) control means responsive to said sensor for activating said first and second motor means for moving said turnstile and panels in the following sequence when the sensor senses the presence of an unwelcome person in said first sector:

i. move said first panel and said turnstile together such that said first panel and the sector adjacent said first panel rotate in a first direction until said first panel blocks said exit aperture, ii. couple said first panel to said second panel and rotate the coupled panels in a second direction opposite said first direction to continue to overlie and bar the exit aperture, iii. further rotate the turnstile in said first direction causing said first sector to rotate past said blocked exit aperture, iv further move said first panel in said second direction to open and unblock said exit aperture, and e. further rotate said turnstile in said first direction enough for sectors upstream and downstream of said first sector to be generally adjacent said entry and exit apertures respectively, and for said sector intermediate said upstream and downstream sectors to be adjacent one of said inner walls of said chamber to intercept said unwelcome person.

10. In a revolving security door apparatus for the controlled passage of persons from a non-protected environment to a protected environment, the apparatus including:

a. a housing having generally cylindrical inner walls which define a chamber about a vertical axis, b. a turnstile rotatable about said axis within said chamber, said turnstile having a plurality of sectors, each for accommodating a person, c. first motor means for rotating said turnstile, and d. said housing further defining separate entry and exit apertures respectively for a person to enter and exit the chamber, (1) an emergency door movably supported by said housing, said emergency door having angular extent at least sufficient to block said exit aperture, (2) second motor means for moving said emergency door to selectively block or expose said exit aperture, (3) means for activating said first and second motor means for moving said turnstile and emergency door in the following sequence when the sensor senses the presence of an unwelcome person in said first sector:

i. move said emergency door to block said exit aperture, ii. rotate said turnstile causing said first sector to rotate past said blocked exit aperture, iii. further move said emergency door to open and unblock said exit aperture, and iv. further rotate said turnstile enough for sectors upstream and downstream of said first sector to be generally adjacent said entry and exit apertures respectively, and for said sector intermediate said upstream and downstream sectors to be adjacent one of said inner walls of said chamber to intercept said unwelcome person.

* * * * *